US007938681B2

(12) United States Patent
Lee et al.

(10) Patent No.: US 7,938,681 B2
(45) Date of Patent: May 10, 2011

(54) COAXIAL CONNECTOR

(75) Inventors: Kuo-Ching Lee, Taipei Hsien (TW); Jian-Guang Guo, Taipei Hsien (TW); Yu-Long Wang, Taipei Hsien (TW)

(73) Assignee: Advanced Connectek Inc., Hsin-Tien (TW)

( * ) Notice: Subject to any disclaimer, the term of this patent is extended or adjusted under 35 U.S.C. 154(b) by 96 days.

(21) Appl. No.: 12/537,477

(22) Filed: Aug. 7, 2009

(65) Prior Publication Data

US 2010/0304609 A1 Dec. 2, 2010

(30) Foreign Application Priority Data

May 27, 2009 (TW) ..... 98209377 U

(51) Int. Cl.
*H01R 13/28* (2006.01)

(52) U.S. Cl. ..... 439/582; 439/585

(58) Field of Classification Search ..... 439/578–585, 439/161, 162

See application file for complete search history.

(56) References Cited

U.S. PATENT DOCUMENTS

| | | | | |
|---|---|---|---|---|
| 5,263,877 | A | 11/1993 | Mitani | |
| 6,837,743 | B2 * | 1/2005 | Ko | 439/582 |
| 7,367,840 | B2 * | 5/2008 | Chen et al. | 439/581 |
| 7,445,458 | B1 * | 11/2008 | Yamane | 439/63 |
| 7,762,841 | B2 * | 7/2010 | Ho | 439/582 |
| 7,806,726 | B2 * | 10/2010 | Chen et al. | 439/582 |

* cited by examiner

*Primary Examiner* — Neil Abrams
*Assistant Examiner* — Phuong T Nguyen
(74) *Attorney, Agent, or Firm* — Rabin & Berdo, P.C.

(57) ABSTRACT

A coaxial connector has a metal shell, an insulative housing and a terminal. The metal shell has a body, a cavity defined in the body and a clamping cover formed on the body. The insulative housing is mounted in the cavity and has a base, a chamber defined in the base and a wire-pressing member being resilient and formed on the base. The terminal is mounted in the chamber and has a plate aligned with the wire-pressing member and two contacting arms protruding from the plate. When a coaxial cable is connected to the coaxial connector, the wire-pressing member is bent to precisely position a core wire of the coaxial cable on the plate and stabilize signal transmission between the coaxial connector and a coaxial cable.

10 Claims, 7 Drawing Sheets

COAXIAL CONNECTOR

BACKGROUND OF THE INVENTION

1. Field of the Invention

The present invention relates to a connector, and more particularly to a coaxial connector that is manufactured without soldering yet provides excellent electrical connection between the coaxial connector and a coaxial cable mounted thereon to improve signal transmission stability and efficiency.

2. Description of Related Art

A conventional coaxial connector is mounted on a coaxial cable and has a metal shell, an insulative housing and a terminal. The metal shell is L-shaped 11 and has a cavity and a clamping cover. The insulative housing is mounted in the cavity. The terminal is mounted in the insulative housing and has a solder cup soldered on a core wire of the coaxial cable. After the insulative housing and terminal are mounted into the metal shell, the clamping cover is bent down to cover the cavity with the core wire mounted securely in the metal shell. However, the core wire and the terminal are soldered together manually through a magnifier so manufacturing the coaxial connector is labor and time intensive and production rate of the coaxial connector is reduced.

U.S. Pat. No. 5,263,877 discloses another coaxial connector connected to a coaxial connector and has a metal shell, an insulative housing and a terminal. The clamping cover has an inner surface and a pressing member mounted on the inner surface. After the insulative housing and the terminal are mounted into the metal shell, the clamping cover is folded and the pressing member presses the core wire of the coaxial cable tightly on the terminal. Thus, the core wire is connected electrically to the terminal for signal transmission. However, the pressing member is not resilient and easily snaps or inadvertently moves after bending. Therefore, the pressing member cannot precisely press against the core wire so that the core wire does not maintain contact with the terminal, so lowering signal transmission stability or causing signal transmission failure.

To overcome the shortcomings, the present invention provides a coaxial connector to mitigate or obviate the aforementioned problems.

SUMMARY OF THE INVENTION

The main objective of the invention is to provide a coaxial connector that is manufactured without soldering yet provides excellent electrical connection between the coaxial connector and a coaxial cable mounted thereon to improve signal transmission stability and efficiency.

A coaxial connector in accordance with the present invention has a metal shell, an insulative housing and a terminal. The metal shell has a body, a cavity defined in the body and a clamping cover formed on the body. The insulative housing is mounted in the cavity and has a base, a chamber defined in the base and a wire-pressing member being resilient and formed on the base. The terminal is mounted in the chamber and has a plate aligned with the wire-pressing member and two contacting arms protruding from the plate. When a coaxial cable is connected to the coaxial connector, the wire-pressing member is bent to precisely position a core wire of the coaxial cable on the plate and stabilize signal transmission between the coaxial connector and a coaxial cable.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
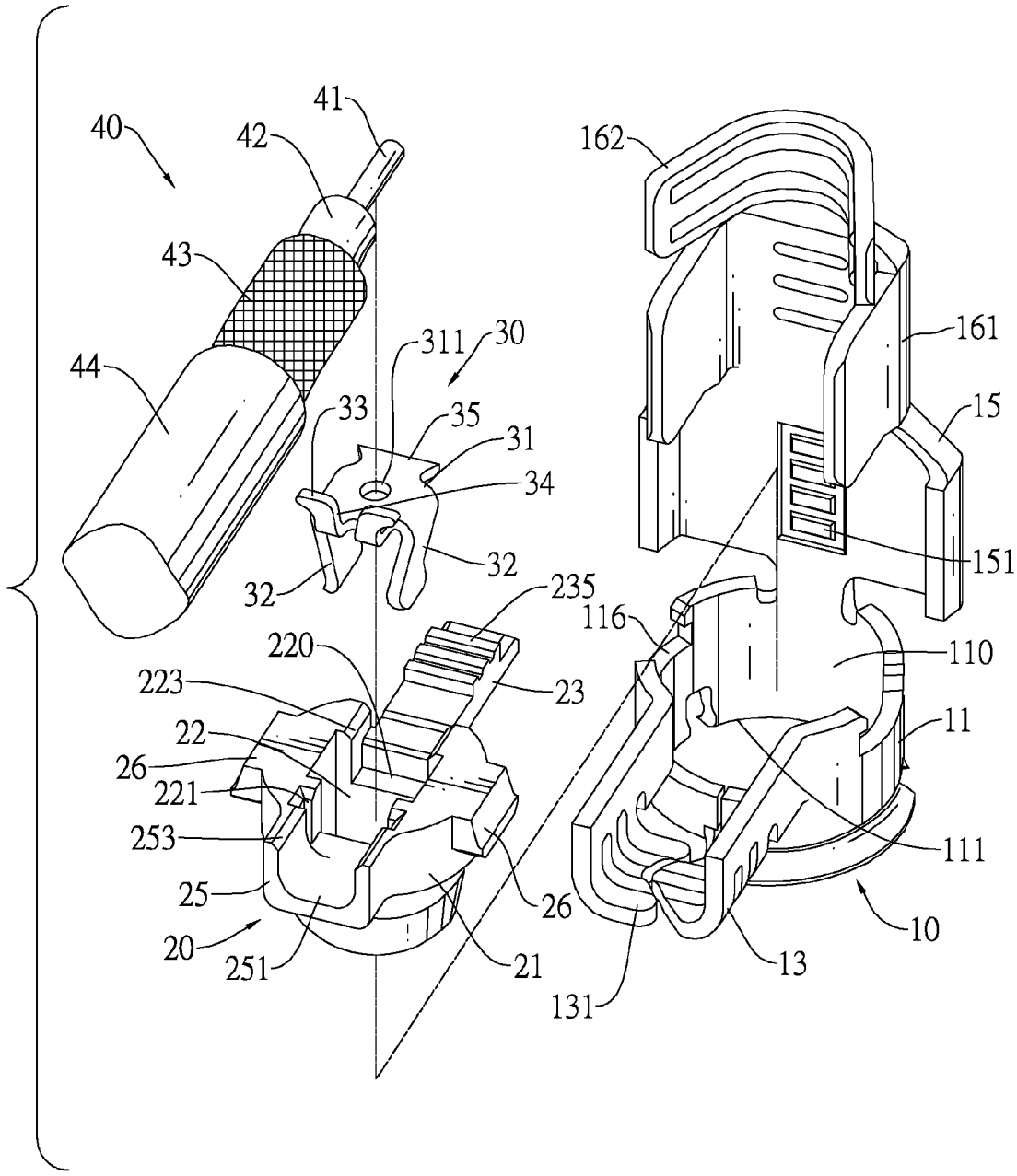
FIG. 1 is an exploded perspective view of a coaxial connector in accordance with the present invention aligned with a coaxial cable and having a clamping cover of a metal shell unfolded.
Figure 2:
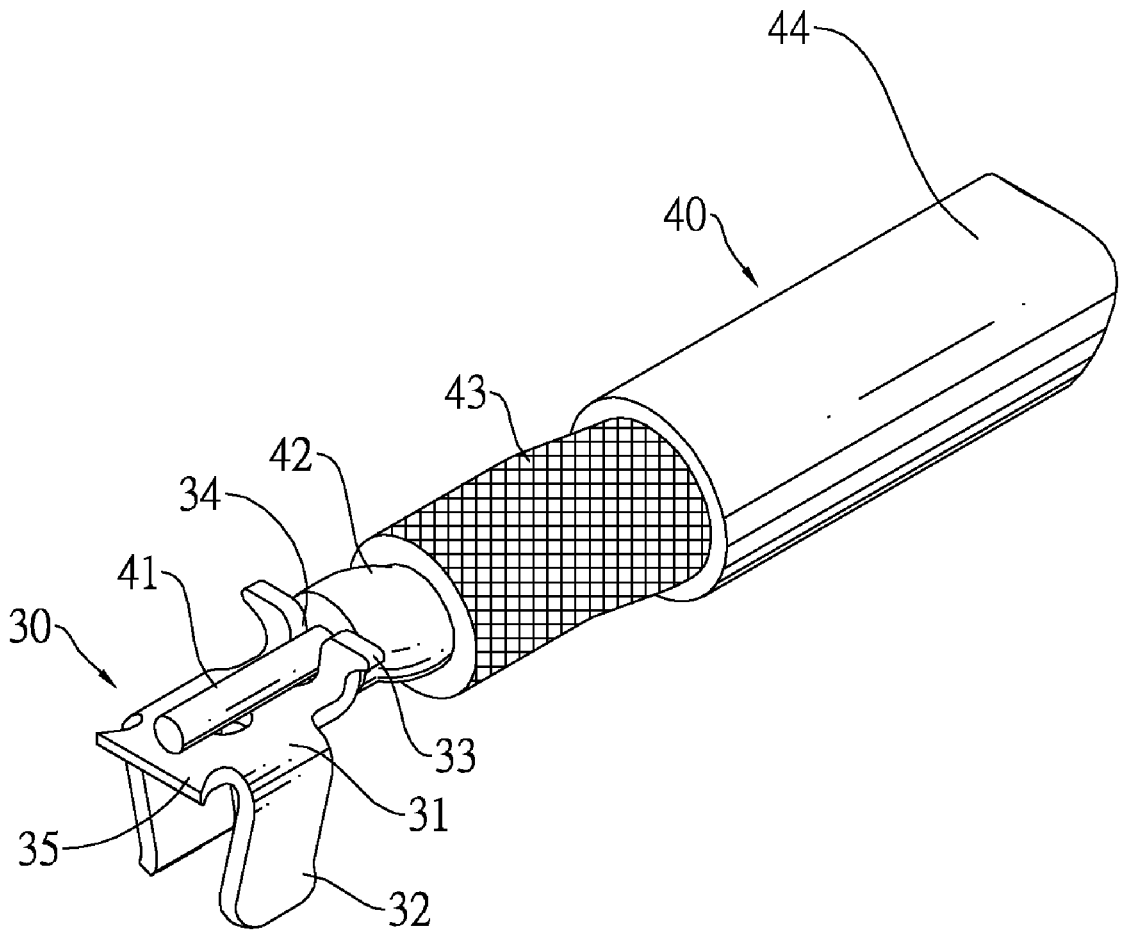
FIG. 2 is a perspective view of a terminal of the coaxial connector in FIG. 1 connected to a core wire of a coaxial cable.
Figure 3:
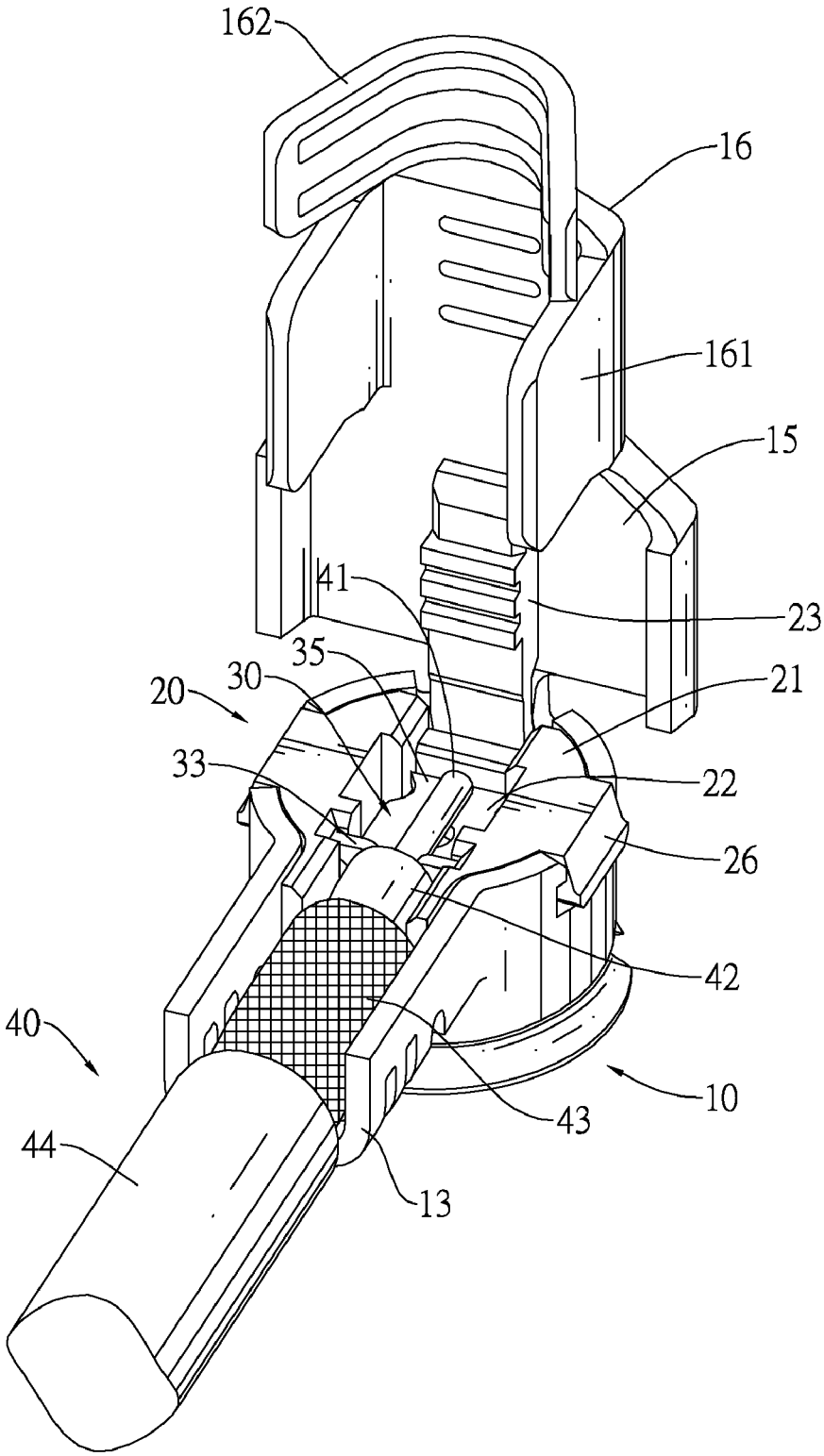
FIG. 3 is a perspective view of the coaxial connector in FIG. 1.
Figure 4:
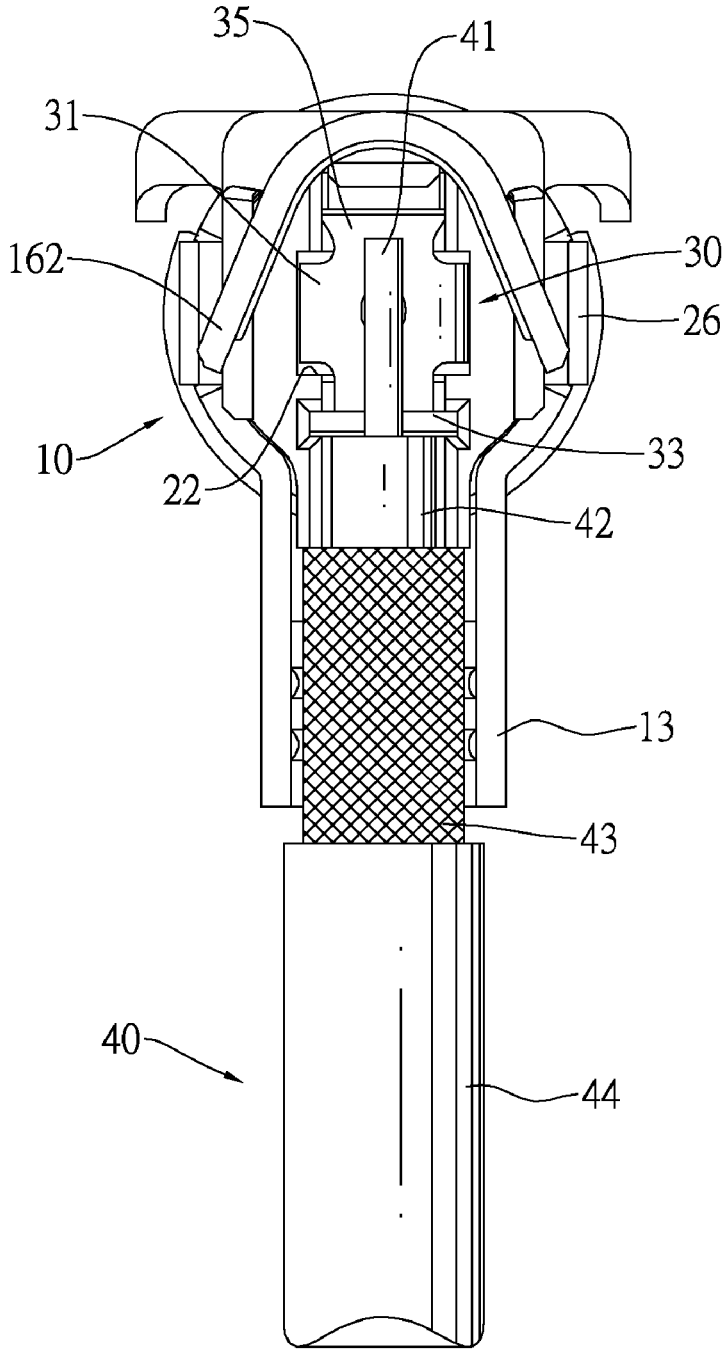
FIG. 4 is a top view of the coaxial connector in FIG. 3.
Figure 5:
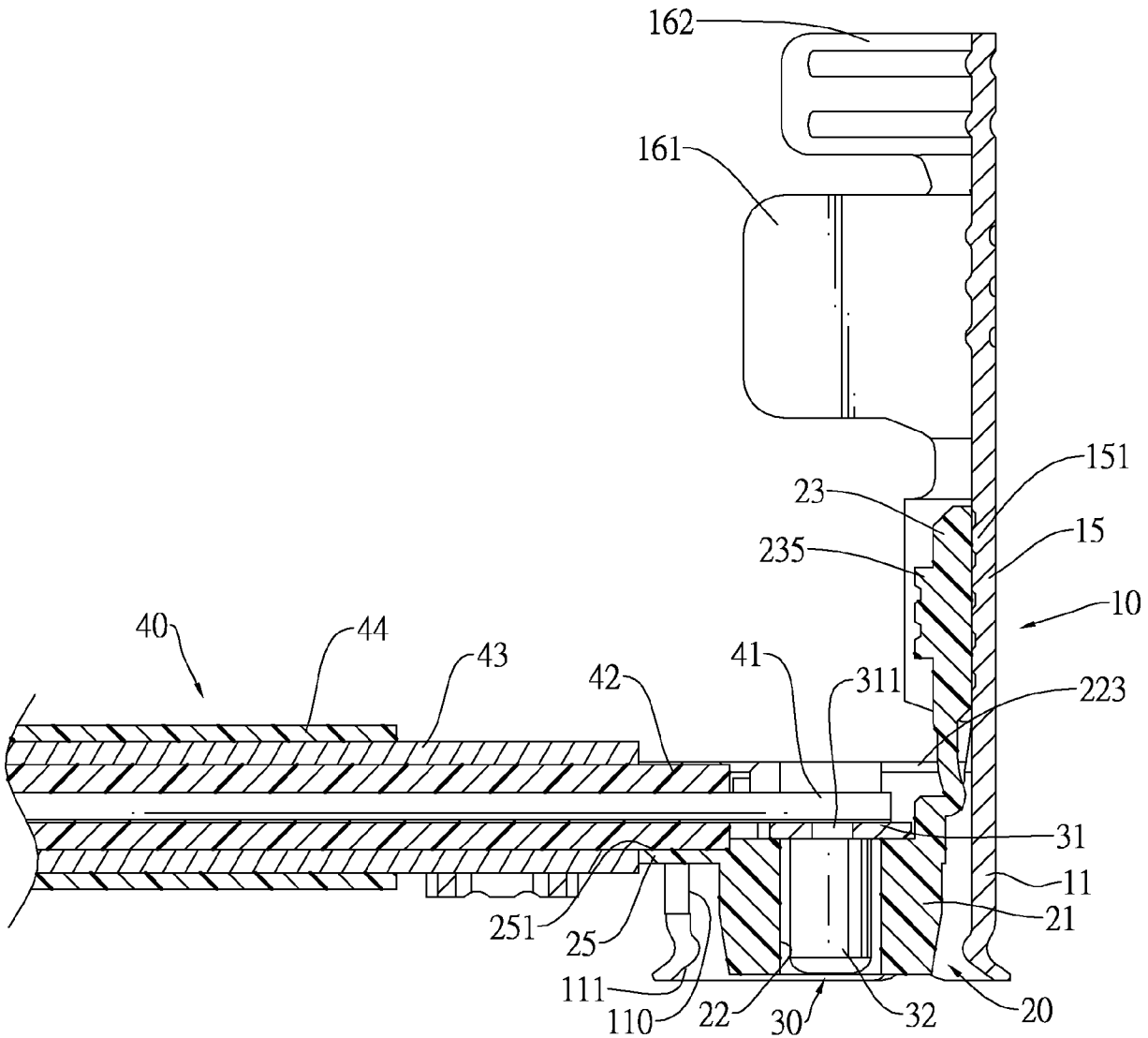
FIG. 5 is a side view in partial section of the coaxial connector in FIG. 3.
Figure 6:
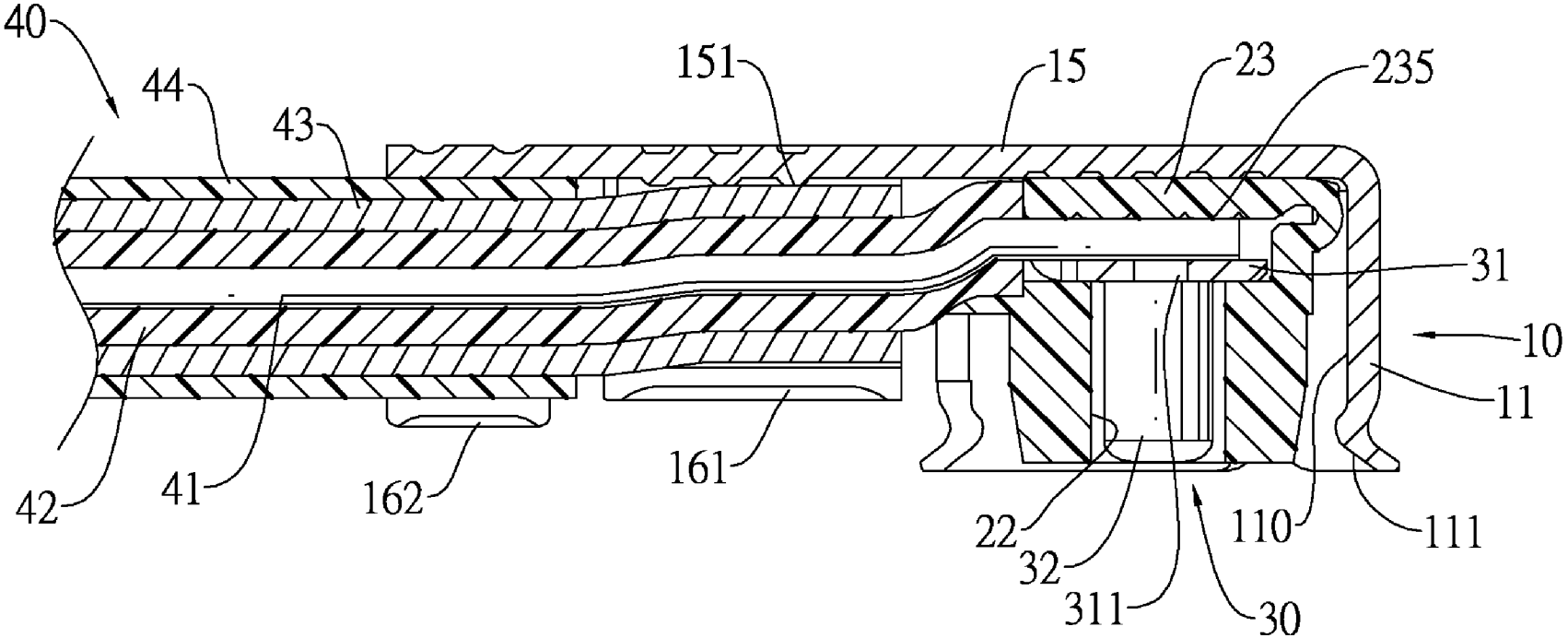
FIG. 6 is a side view in partial section of the coaxial connector in FIG. 5 with the clamping cover folded to securely hold the core wire in the coaxial connector.
Figure 7:
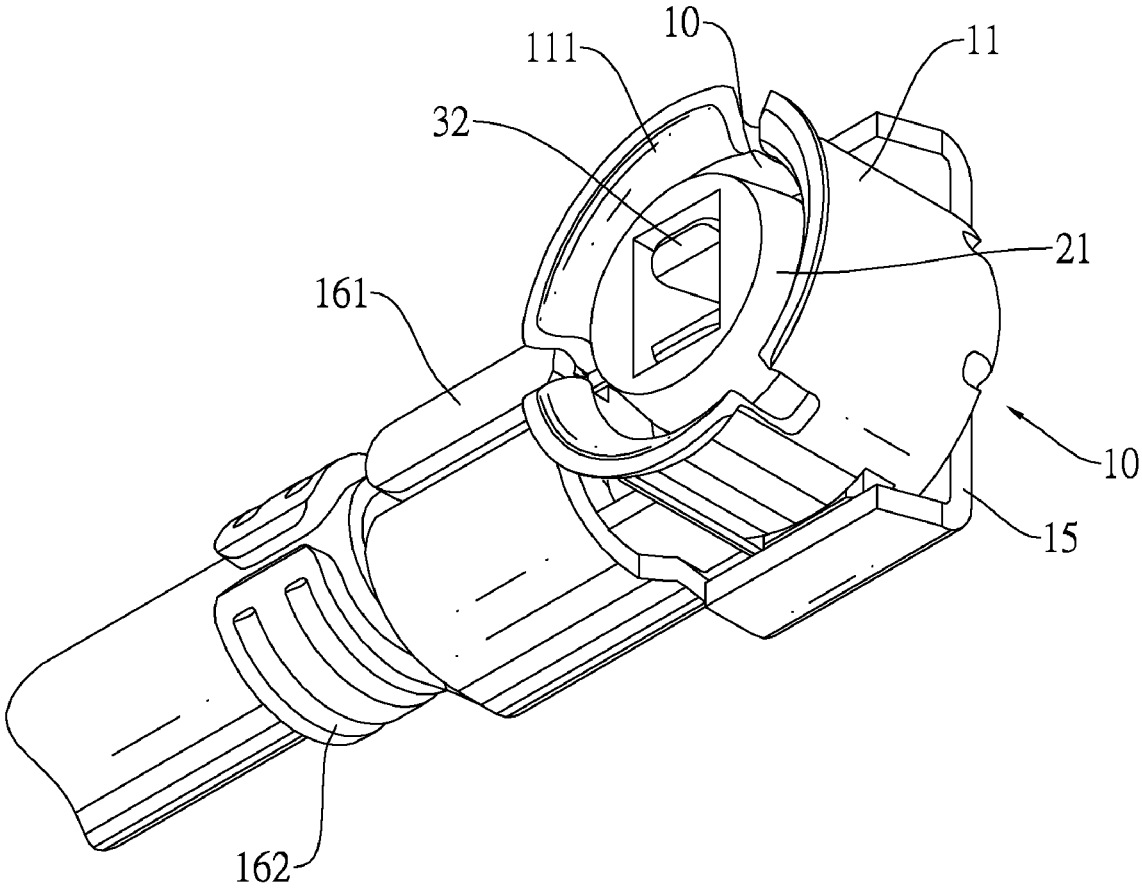
FIG. 7 is a perspective view of the coaxial connector in FIG. 6.

With reference to FIGS. 1 to 3, a coaxial connector in accordance with the present invention is connected to a coaxial cable (40). The coaxial cable (40) has a core wire (41), an inner insulator (42), a mesh shield (43) and an insulative jacket (44) sequentially formed from a center to an outside of the coaxial cable (40).

The coaxial connector in accordance with the present invention comprises a metal shield (10), an insulative housing (20) and a terminal (30).

The metal shell (10) has a body (11), a mounting bracket (13) and a clamping cover (15).

The body (11) has a cavity (110) and may further have two opposite positioning recesses (116). The cavity (110) is defined through the body (11) and has a socket opening (111) to accommodate a corresponding coaxial plug connector. The positioning recesses (116) are defined in body (11).

The mounting bracket (13) is formed on and protrudes outwards from the body (11) and has a cable slot (131) defined in the mounting bracket (13) to accommodate the coaxial cable (40).

The clamping cover (15) is formed on and protrudes perpendicularly upwards from the body (11) and is capable of bending towards the body (13) to cover the cavity (110) and the cable slot (131). The clamping cover (15) has an inner surface and a distal end and may further have at least on pair of clamping wings (161, 162) and at least one friction rib (151). The at least one pair of clamping wings (161, 162) is formed on and protrudes from the clamping cover (15) and selectively bends to surround and clamp the coaxial cable (40). The at least one friction rib (151) is formed on the inner surface of the clamping cover (15).

The insulative housing (20) is mounted in the cavity (110) of the metal shell (10) and has a base (21) and a wire-pressing member (23) and may further have a cable bracket (25).

The base (21) is mounted in the cavity (110) and has a top and a chamber (22) and may further have two opposite positioning protrusions (26). The chamber (22) is defined in the base (21) and has an inner surface, a fastening recess (220), two opposite notches (221) and two opposite sloping guides (223). The fastening recess (220) is defined in the inner surface of the chamber (22) and has two opposite side surfaces. The notches (221) are defined in the inner surface of the chamber (22). The sloping guides (223) are formed on the inner surface of the chamber (22) adjacent to the top. The positioning protrusions (26) are formed on the base (21) and are mounted respectively in the positioning recesses (116) of the metal shell (10) and may be press-fitted respectively in the positioning recesses (116) to prevent the insulative housing (20) from moving relative to the metal shell (10). The positioning protrusions (26) may be trapezoid to facilitate tightly fitting the positioning protrusions (26) in the positioning recesses (116).

With further reference to FIGS. 4 to 7, the wire-pressing member (23) is resilient and insulative, is formed on and protrudes outwards from the base (21), may abut the at least one friction rib (151) on the inner surface of the clamping cover (15) and selectively bend towards and covers the chamber (22) of the base (21). The wire-pressing member (23) may be guided by the sloping guides (223) to smoothly and precisely cover the chamber (22). In a preferred embodiment, the wire-pressing member (23) protrudes radially and horizontally outwards from the base (21) before the insulative housing (20) is mounted in the cavity (110) of the metal shell (10). The horizontal configuration of the wire-pressing member (23) facilitates manufacture thereof by an insert molding process. The wire-pressing member (23) has an inner surface and may further have at least one friction ridge (235) formed on the inner surface.

When the clamping cover (15) of the metal shell (10) bends, the wire-pressing member (23) is pressed and folded by the clamping cover (15) towards the chamber (23) and presses tightly against the core wire (41) of the coaxial cable (40) in the chamber (23). The at least friction ridge (235) tightly abuts the core wire (41) to prevent inadvertent slip therebetween.

The cable bracket (25) is formed on and protrudes radially from the base (21) opposite to the wire-pressing member (23) and has a top surface, a cable recess (251) and two inclined guides (253). The cable recess (251) is defined in the cable bracket (25) and has an inner surface and may hold the mesh shield (43) of the coaxial cable (40). The inclined guides (253) are formed on the inner surface of the cable recess (251) adjacent to the top surface and guide the mesh shield (43) to smoothly fit into the cable recess (251).

The terminal (30) is mounted in the chamber (23) of the insulative housing (20) and has a plate (31) and two opposite contacting arms (32) and may further have two opposite clamping portions (33), a wire gap (34) and a fastening portion (35).

The plate (31) is aligned with the wire-pressing member (23), may hold the core wire (41) of the coaxial cable (40) and has two opposite sides and an alignment hole (311). The alignment hole (311) is defined through the plate (31), is aligned with the wire-pressing member (23) and may be aligned with the core wire (41) to ensure that the core wire (41) is set precisely under the wire-pressing member (23).

The contacting arms (32) are formed respectively on and protrude downwards from the sides of the plate (31) towards the socket opening (111) and may contact a terminal of a corresponding plug connector connected to the coaxial connector.

The clamping portions (33) are formed on and protrude upwards from the plate (31) and are inserted respectively in the notches (221) of the insulative housing (20) to position the terminal (30) in the insulative housing (20).

The wire gap (34) is defined between the clamping portions (33) to tightly clamp and prevent the core wire (41) of the coaxial cable (40) from inadvertent disengagement therefrom.

The fastening portion (35) is formed on and protrudes from the plate (31), is mounted in the fastening recess (220) and has two opposite sharp tips stabbing respectively in the side surface of the fastening recess (220) to further fasten the terminal (30) in the chamber (23) of the insulative housing (20).

When the coaxial cable (40) is connected to the coaxial connector, the core wire (41) is set on the plate (31) of the terminal (30) mounted in the chamber (22) of the insulative housing (20). Then the clamping cover (15) is folded and pushes the resilient wire-pressing member (23) of the insulative housing (20) to bend towards and press against the core wire (41). The core wire (41) is pressed and mounted tightly on the plate (31) of the terminal (31).

The coaxial connector with the wire-pressing member (23) is connected to the coaxial cable (40) without any soldering process. The wire-pressing member (23) formed integrally on the insulative housing (20) precisely and securely covers the chamber (22) and accurately positions the core wire (41) of the coaxial cable (40) to the plate for stable signal transmission between the coaxial connector and coaxial cable (40). The sloping guides (223) ensure that the wire-pressing member (23) accurately covers the chamber (23). Furthermore, the wire-pressing member (23) made of resilient material is flexible for repeated bending and prevent inadvertent breakage when the wire-pressing member (23) folds to position the core wire (41) so that the electrical contact between the terminal (30) and the core wire (41) is secure and reliable. Moreover, the inclined guides of the cable recess (251) of the cable bracket (25) of the insulative housing (20) guide the mesh shield (43) to smoothly fit into the cable recess (251). Therefore, the coaxial connector is connected easily and conveniently to the coaxial cable (40) and is durable.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A coaxial connector comprising:

a metal shell having a body having two opposite sides and a cavity defined through the body;

a mounting bracket formed on and protruding outwards from the body and having a cable slot defined in the mounting bracket; and a clamping cover formed on and protruding from the body, capable of bending towards the body to cover the cavity and the cable slot and having an inner surface;

an insulative housing mounted in the cavity of the metal shell and having a base mounted in the cavity and having a top; and a chamber defined in the base and having an inner surface; and a wire-pressing member made of resilient and insulative material, formed on and protruding outwards from the base, selectively bending towards and cover the chamber of the base and having an inner surface; and a terminal mounted in the chamber of the insulative housing and having a plate aligned with the wire-pressing member and having two opposite sides; and two contacting arms formed respectively on and protruding downwards from the sides of the plate;

the clamping cover protrudes upwards from the body and the wire-pressing member abuts the inner surface of the clamping cover;

the wire-pressing member protrudes radially and horizontally outwards from the base before the insulative housing is mounted in the cavity of the metal shell;

the base of the insulative housing further has two opposite notches defined in the inner surface of the chamber; and the terminal further has two opposite clamping portions formed on and protrude upwards from the plate and inserted respectively in the notches of the insulative housing; and a wire gap defined between the clamping portion.

2. The coaxial connector as claimed in claim 1, wherein the chamber of the insulative housing further has a fastening recess defined in the inner surface of the chamber and having two opposite side surfaces; and the terminal further has a fastening portion formed on and protruding from the plate, mounted in the fastening recess and having two opposite sharp tips stabbing respectively in the side surfaces of the fastening recess.

3. The coaxial connector as claimed in claim 2, wherein the base of the insulative housing further has two opposite sloping guides formed on the inner surface of the chamber adjacent to the top of the base and guiding the wire-pressing member to cover the chamber.

4. The coaxial connector as claimed in claim 3, wherein the insulative housing further a cable bracket formed on and protruding radially from the base opposite to the wire-pressing member and having a top surface;

a cable recess defined in the cable bracket and having an inner surface; and two inclined guides formed on the inner surface of the cable recess adjacent to the top surface.

5. The coaxial connector as claimed in claim 4, wherein the clamping cover further has at least one friction rib formed on the inner surface of the clamping cover and abutting the wire-pressing member.

6. The coaxial connector as claimed in claim 5, wherein the wire-pressing member further at least one friction ridge formed on the inner surface of the wire-pressing member.

7. The coaxial connector as claimed in claim 6, wherein the body of the metal shell further has two positioning recesses defined in the body; and the base of the insulative housing further has two opposite positioning protrusions formed on the base and mounted respectively in the positioning recesses of the metal shell.

8. The coaxial connector as claimed in claim 7, wherein the clamping cover further has at least one pair of clamping wings formed on and protruding from the clamping cover.

9. The coaxial connector as claimed in claim 8, wherein the plate of the terminal further has an alignment hole defined through the plate and aligned with the wire-pressing member.

10. The coaxial connector as claimed in claim 9, wherein the positioning protrusions are press-fitted respectively in the positioning recesses.

* * * * *